US005092427A

United States Patent [19]

MacMillan

[11] Patent Number: 5,092,427

[45] Date of Patent: Mar. 3, 1992

[54] CONVERTIBLE LADDER CLAMP COMBINATION

[76] Inventor: Kenneth T. MacMillan, 115 Oxford Sq., Carrollton, Ga. 30117

[21] Appl. No.: 727,187

[22] Filed: Jul. 9, 1991

[51] Int. Cl.[5] ..... E06C 1/38; E06C 7/14

[52] U.S. Cl. ..... 182/20; 182/129; 182/186; 269/86

[58] Field of Search ..... 182/20, 21, 22, 129, 182/186, 226, 117, 27; 269/86, 901

[56] References Cited

U.S. PATENT DOCUMENTS 1,174,964 3/1916 Bradley ..... 182/166
3,055,453 9/1962 Vanyo ..... 182/186
4,236,599 12/1980 Luff ..... 182/129

*Primary Examiner*—Reinaldo P. Machado

*Attorney, Agent, or Firm*—Diller, Ramik & Wight

[57] ABSTRACT

A convertible ladder-clamp combination as disclosed which includes first and second sides each having upper and lower end portions and a plurality of rungs therebetween. Each upper end portion carries a clamping member between which an object can be clamped when the lower ends of the sides are moved apart. The sides are preferably selectively adjustably connected to each other at the upper portions to thereby vary the spatial relationship between the clamping members to effect clamping of different size objects. At least one of the clamping members may be mounted in a slidable biased relationship to the other of the clamping members to provide a yielding clamping force to an object clamped therebetween which is particularly advantageous when clamping fragile, brittle or like objects.

23 Claims, 8 Drawing Sheets

CONVERTIBLE LADDER CLAMP COMBINATION

BACKGROUND OF THE INVENTION

This invention is directed to an apparatus which can be used both as a ladder and as a clamp, thus being nominally termed a convertible ladder-clamp or ladder-clamp combination. Heretofore ladders were utilized for climbing up and down while clamps were utilized for holding or binding two or more objects firmly together. A single structure for accomplishing both of the aforementioned functions has, however, heretofore been unknown.

SUMMARY OF THE INVENTION

A novel convertible ladder-clamp combination of the present invention includes first and second sides each having upper and lower end portions and a plurality of rungs therebetween. Each upper end portion carries a clamping member between which an object can be clamped when the lower ends of the sides are moved apart. The sides are preferably selectively adjustably connected to each other at the upper portions to thereby vary the spatial relationship between the clamping members to effect clamping of different size objects.

In further accordance with the invention, at least one of the clamping members is mounted in a slidable relationship to the other of the clamping members and is biased toward the same. The ladder structure provides a yielding clamping force to an object clamped between the two clamping members which is particularly advantageous should the object being clamped be constructed of fragile, brittle or similar material.

The convertible ladder-clamp combination or mechanism is also provided with a retaining bar which holds the lower ends of the sides spread away from each other during the clamping of an object between the clamping members to thus free the hands (and feet) of a user to perform desired objectives relative to the clamped object or workpiece.

The convertible ladder-clamp mechanism also includes as part of the selective adjustable connecting means an adjusting member having opposite end portions with one end portion of the adjusting member being pivotally connected to one of the sides and the other end of the adjusting member having a series of interconnected enlarged openings which cooperate with a stem to achieve stepwise adjustment of the side upper ends or end portions to accommodate different sized objects or workpieces.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
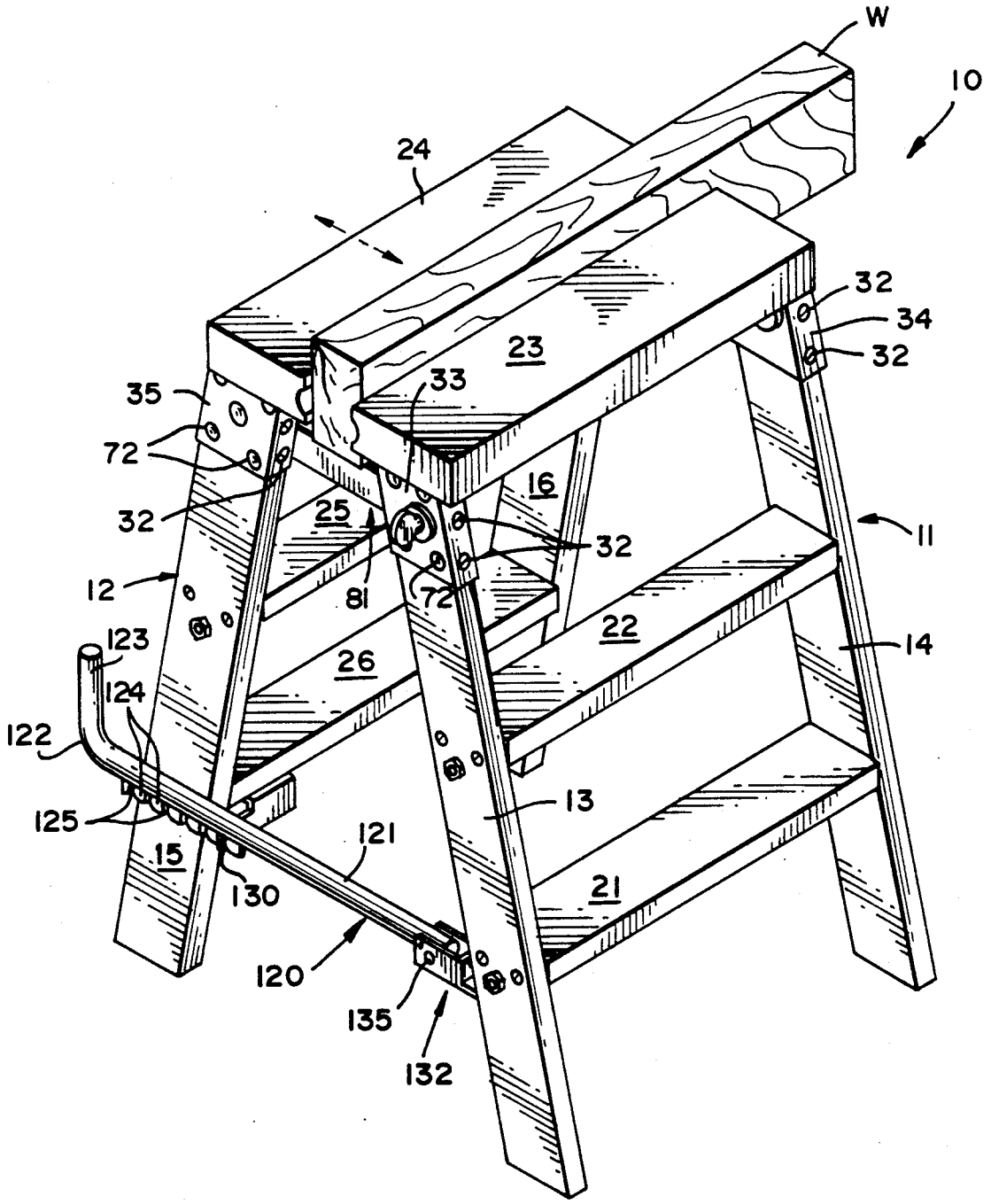
FIG. 1 is a perspective view of a novel convertible ladder-clamp combination or mechanism constructed in accordance with this invention, and illustrates an object or workpiece clamped between a pair of clamping members each carried by a side of the mechanism at upper ends thereof and means spanning lower ends of the sides for maintaining the sides in downwardly diverging relationship.

A novel convertible ladder-clamp combination or mechanism is illustrated in FIGS. 1–4 of the drawings and is generally designated by the reference numeral 10.

The ladder-clamp mechanism 10 includes a first side 11 and a second side 12 each having respective side rails or legs 13, 14 and 15, 16, respectively. Rungs 21, 22 are suitably connected between the rails 13, 14. Another rung 23, which is also a clamping member, is connected between the rails 13, 14 in a manner to be described more fully hereinafter. The rung or clamping member 23 opposes another rung or clamping member 24 which is carried by an upper end portion of the side 12 and spans the rails 15, 16. Additional rungs or steps 25, 26 are suitably connected between the rails 15, 16.

In FIG. 1 the convertible ladder-clamp mechanism 10 is illustrated with an object or workpiece W clamped between the clamping members 23, 24 and the manner in which the clamping action is effected shall be described more fully hereinafter.

Figure 3:
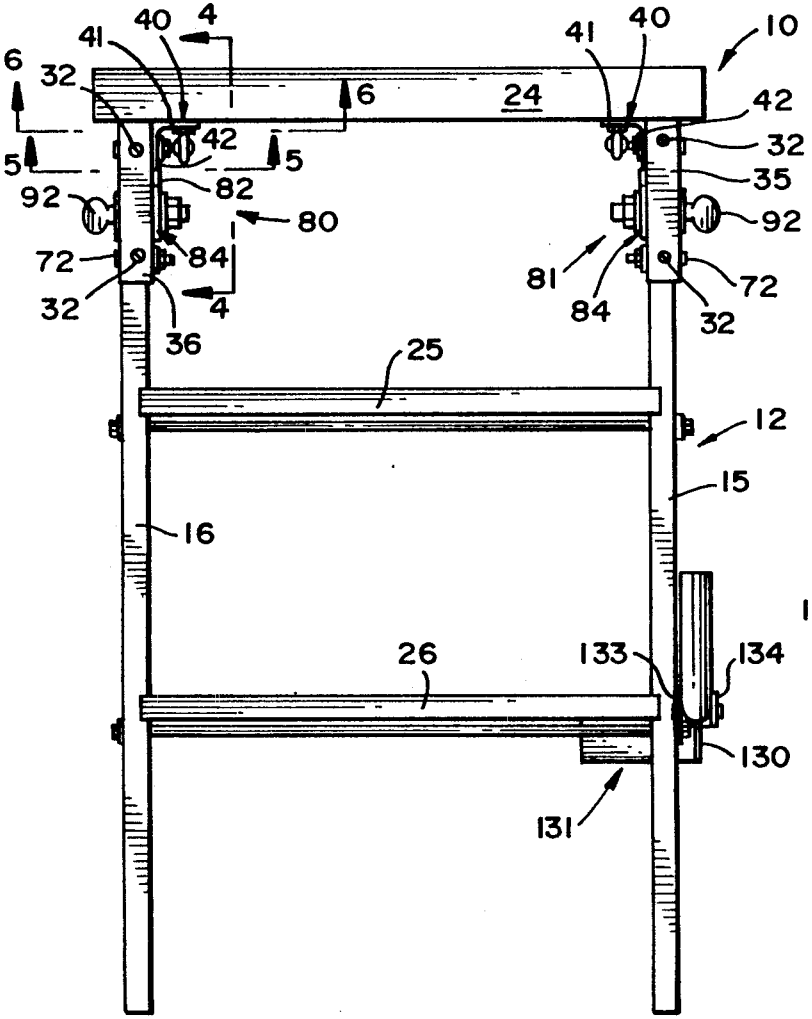
FIG. 3 is a front elevational view of the ladder-clamp mechanism.

Upper ends of the rails 13–16 are each reinforced by a metallic sleeve 33–36, respectively. The metallic sleeves 33–36 are generally of a rectangular cross sectional configuration, as is best illustrated in FIGS. 5 and 6, and each metallic sleeve 33–36 is secured to its associated respective rail 13–16 by screws 32 (FIG. 3).

Figure 4:
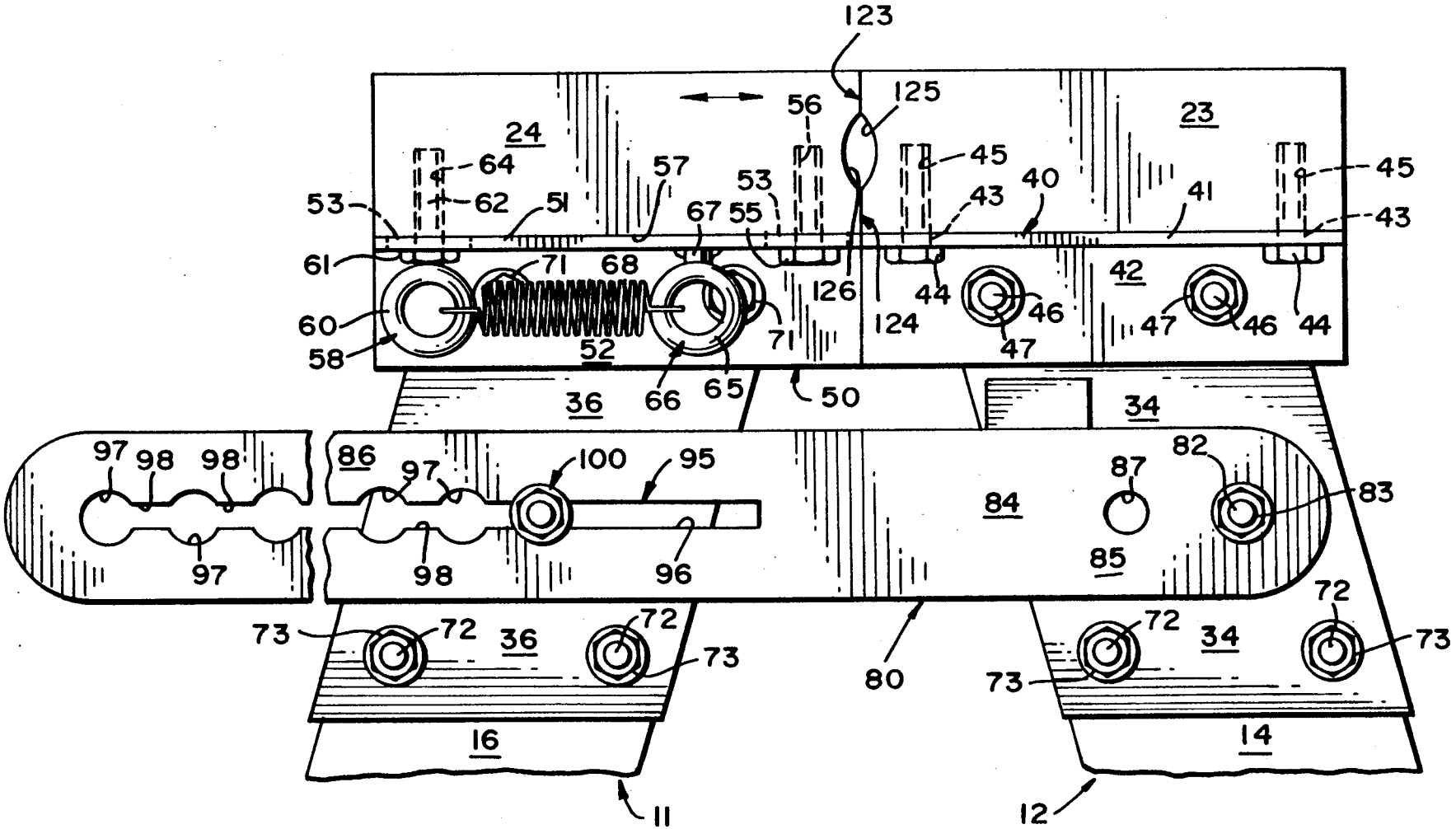
FIG. 4 is an enlarged fragmentary cross sectional view taken generally along line 4—4 of FIG. 3, and illustrates details of the selective adjustable connecting mechanism, and a biasing mechanism for one of the two clamping members.
Figure 6:
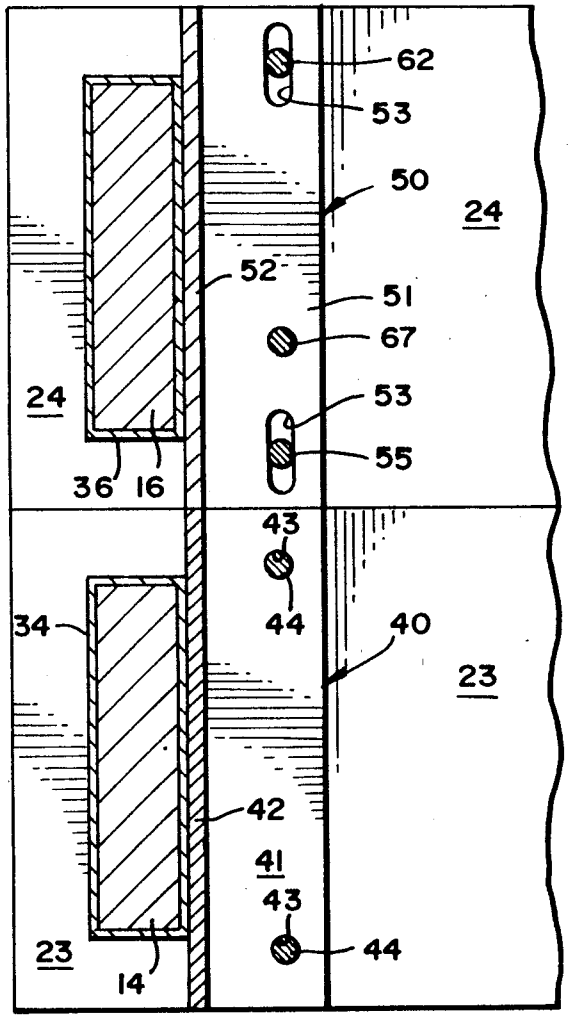
FIG. 6 is an enlarged fragmentary cross sectional view taken generally along line 6—6 of FIG. 3, and illustrates further details of the clamping mechanism.
Figure 5:
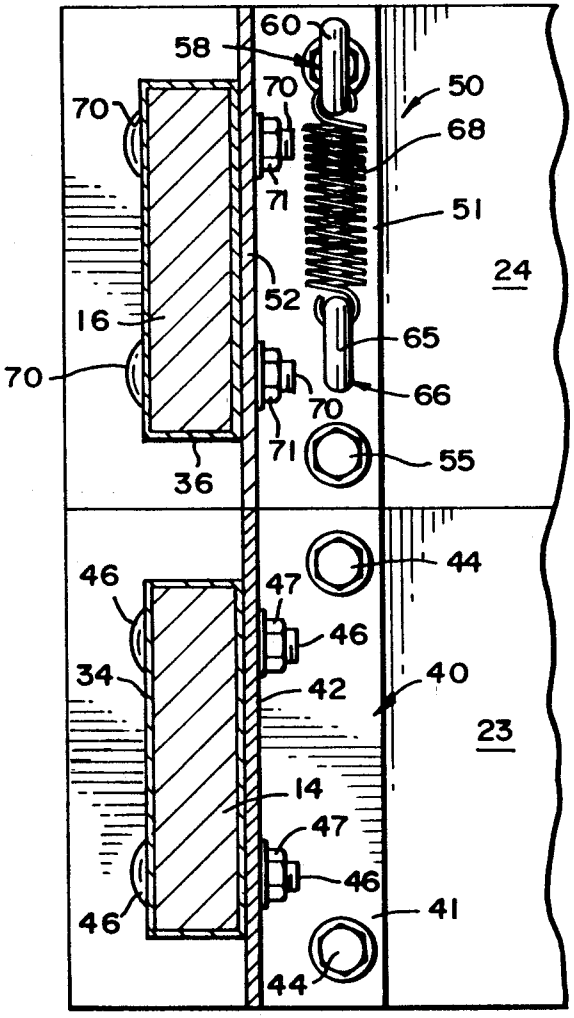
FIG. 5 is an enlarged fragmentary cross sectional view taken generally along line 5—5 of FIG. 3, and illustrates details of the biasing mechanism for urging one of the clamping members toward the other of the clamping members.

The rung or clamping member 23 is not only in spanning relationship to the legs 13, 14, but is rigidly secured thereto and to the respective sleeves 33, 34 in the manner best illustrated in FIGS. 4–6 of the drawings. A generally L-shaped bracket 40 is defined by a generally horizontal leg 41, and a vertical leg 42. The horizontal leg 41 has two circular openings 43 (FIGS. 4 and 6) formed therein and a similar pair of horizontal openings (not shown) are formed in the vertical leg 42. Threaded bolts or screws 44 pass through the openings 43 of the horizontal leg 41 of the bracket 40 and are received in threaded or unthreaded bores 45 of the clamping member 23 (FIG. 4). Threaded bolts 46 (FIGS. 4 and 5) pass through openings (not shown) in the leg 14 and the sleeve 34 and through the openings in the vertical leg 42 of the bracket 40. Nuts 47 are secured to the threaded portion (unnumbered) of the bolts 46 to rigidly secure the leg 14 of the L-shaped bracket 40 to the vertical leg 42 of the L-shaped bracket 40.

An identical L-shaped bracket corresponding to the L-shaped bracket 40 and corresponding bolts and nuts secure the opposite end of the clamping member or rung 23 to the leg 13 and its associated sleeve 33.

The clamping member or rung 24 is not only in spanning relationship between the rails or legs 15, 16, but is also mounted slidably relative thereto and relative to the rung or clamping member 23. A generally L-shaped bracket 50 (FIGS. 4–6) includes a horizontal leg 51 and a vertical leg 52. The horizontal leg 51 is provided with two elongated aligned slots 53. A single threaded bolt or screw 55 passes through the elongated slot 53 most adjacent the clamping member 23 (see FIG. 4). The bolt 55 is threaded into a threaded or unthreaded bore 56 and is tightened so as to retain the horizontal leg 51 snugly against a bottom surface 57 of the clamping member 24. An eye bolt 58 includes an eye 60, a circular collar 61 and a threaded stem or shank 62 which passes through the slot 53 of the horizontal leg 51 most remote from the clamping member or rung 23. The threaded shank 62 is threaded into a threaded or unthreaded bore 64 formed in the clamping member 24. The eye bolt 58 is threaded sufficiently to bring the horizontal leg 51 into snug engagement with the bottom surface 57 of the clamping member 24. As is most readily apparent from FIG. 4, the bolt 55 and the eye bolt 58 allow the clamping member 24 to slide in a reciprocal fashion, as indicated by the oppositely headed arrow in FIG. 4 associated with the clamping member 24. The extent of sliding movement of the clamping member 24 relative to and upon the horizontal leg 51 of the L-shaped bracket 50 is controlled by the slots 53 which are effectively limited in their motion by the threaded stem 62 and the threaded portion (unnumbered) of the bolt 55.

Another eye bolt 66 includes an eye 65 and a stem 67 which is welded to the horizontal leg 51 of the L-shaped bracket 50. A tension spring 68 is connected between the eyes 60, 66 and normally biases or pulls the clamping member 24 to the right, as viewed in FIG. 4, toward the clamping member 23 which allows the workpiece W to be yieldably clamped between respective clamping surfaces or faces 123, 124 of the respective clamping members 23, 24. The clamping surfaces or faces 123, 124 include respective opposing curved or recessed surfaces 125, 126, respectively, to facilitate clamping objects with round or curved exterior surfaces, as opposed to the planar surfaces (unnumbered) of the object or workpiece W.

The vertical leg 52 of the L-shaped bracket 50 is connected to the leg 16 and the sleeve 36 by a pair of bolts 70 (FIG. 5) which pass through aligned openings (none shown) in the sleeve 36, the leg 16 and the vertical leg 52 of the L-shaped bracket 50. Nuts 71 (FIG. 5) are fastened to threaded end portions (unnumbered) of the bolts 70.

The leg 15 and the sleeve 35 are connected to the opposite end of the clamping member or rung 24 by a structure identical to that just described, namely, brackets, bolts, eye bolts, openings, slots and a spring corresponding to the respective elements 50, 53, 55, 58, 66 and 68. Accordingly, springs 68 at opposite ends of the clamping member 24 effectively direct a biasing force in a direction continuously urging the clamping member 24, and specifically the clamping face 124 thereof, toward the clamping member 23 and its clamping face 123.

An additional pair of bolts 72 is passed through openings (not shown) in each of the sleeves 33–36 and the respective legs 13–16 thereof, and a nut 73 (FIG. 4) is tightly fastened to the threaded portion (unnumbered) of each bolt 72. In this fashion four bolts 70, 70, 72, 72 rigidly attach each leg or rail 13–16 to its respective sleeve 33–36.

Identical means 80, 81 are associated with the respective legs 14, 16 and 13, 15 for selectively adjustably connecting the sides 11, 12 together at different distances from each other to thereby selectively place the clamping members 23, 24 in intimate/contacting relationship (FIG. 2) or spaced a considerable distance from each other (FIG. 1) so that different sized workpieces (W) can be clamped therebetween. Since the selective adjustable connecting means 80, 81 are identical, the following description of the means 80 is equally applicable to the means 81.

The selective adjustable connecting means 80 includes an adjusting member 84 which is a relatively long, thin, flat, rigid piece of metal having a first end portion 85 adjacent and inboard of the sleeve 34 and an opposite second end portion 86 inboard and adjacent the sleeve 36. A bolt 82 (FIG. 4) passes through openings (not shown) in the leg 14, the sleeve 34 and the first end portion 85 of the adjusting member 84. A head (not shown) of the bolt rests against the opposite side of the sleeve 34 shown in FIG. 4 and a nut 83 is connected to the threaded stem (unnumbered) of the bolt 82. Thus the bolt 82 serves as a rigid pivot which allows relative pivoting movement of the leg 14 with respect to the adjusting member 84 and, of course, a like relative pivoting movement between the opposite leg 13 (FIGS. 1 and 2) and the associated adjusting member 84 of the adjusting means 81.

Figure 9:
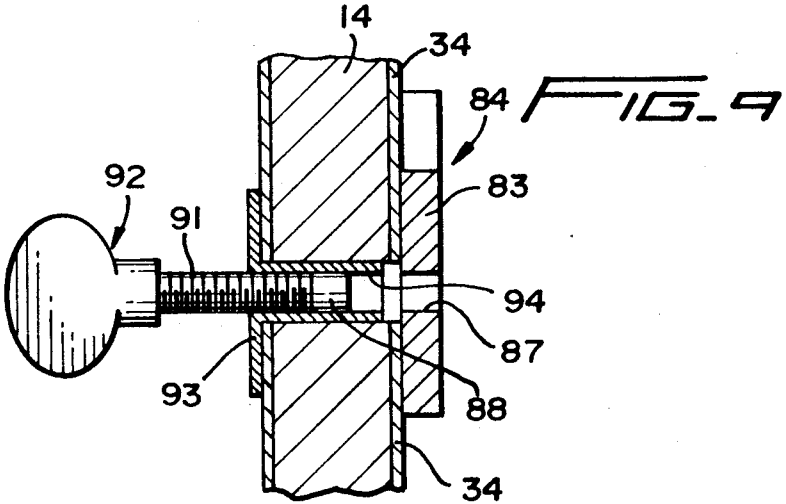
FIG. 9 is an enlarged fragmentary cross sectional view taken generally along line 9—9 of FIG. 2, and illustrates a thumb screw in its retracted position for effecting collapse of the sides to achieve the position shown in FIGS. 14 and 15.
Figure 10:
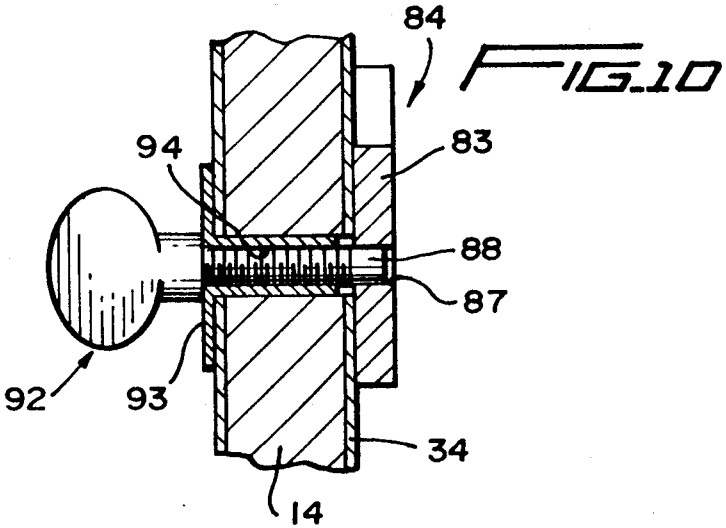
FIG. 10 is a fragmentary cross sectional view of the thumbscrew of FIG. 9 and illustrates the thumbscrew in its seated position which maintains the upper portions of the sides in the manner illustrated in FIG. 1, 2 and 4 of the drawings.

A smaller opening 87 (FIGS. 9 and 10) is also formed in the first end portion 85 of the adjusting member 84. The opening 87 can be aligned with and is adapted to receive an unthreaded cylindrical end 88 of a threaded stem 91 of a thumbscrew 92 which is threaded in a tubular sleeve 93 fixed in a bore or opening 94 of the leg 14 which is aligned with similar openings (unnumbered) in opposite sides (unnumbered) of the sleeve 34. When the thumbscrew 92 is threaded to the position shown in FIG. 10, the cylindrical end 88 enters the opening 87 of the adjusting member 84 and prevents relative movement between the adjusting member 84 and the rail or leg 14, while unthreading of the thumbscrew 92 to the position shown in FIG. 9 has the opposite effect.

The second end portion 86 of the adjusting member 84 includes slot means 95 in the form of an elongated slot having a long narrow terminal slot end portion 96 and a plurality of generally circular slot portions 97 bridged by short narrow slot portions 98.

Figure 7:
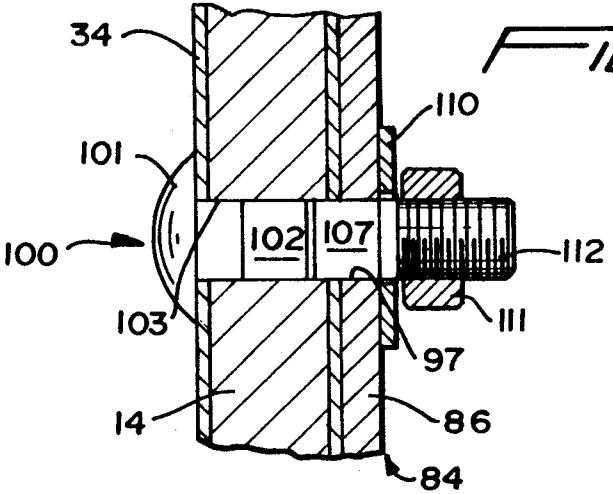
FIG. 7 is an enlarged fragmentary cross sectional view taken generally along line 7—7 of FIG. 2, and illustrates a bolt having a square shank portion nonrotatably seated in a square hole of a rail of one of the sides.
Figure 8:
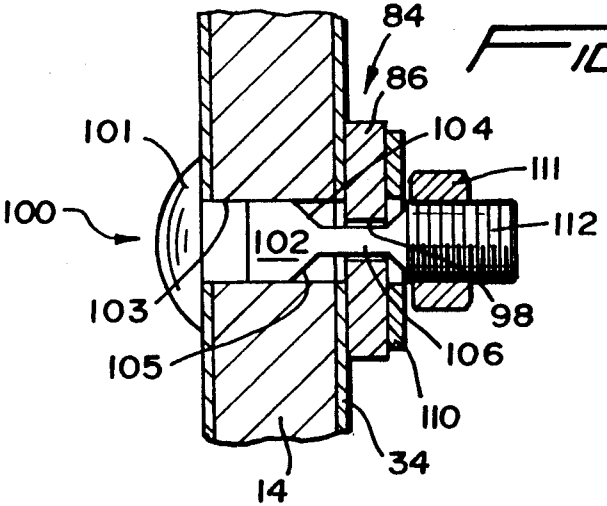
FIG. 8 is a cross sectional view identical to FIG. 7 but rotated 90°, and illustrates a shank portion of the threaded bolt which permits adjustment thereof along an adjusting member or bar.

A bolt 100 (FIGS. 7 and 8) includes a head 101 and a square section shank portion 102 which is received in a square opening 103 of the leg 14. The square section shank portion 102 merges with opposite faces 104, 105 which converge to the right, as viewed in FIG. 8, resulting in the formation of a narrow shank portion 106 (FIG. 8) sized to readily pass through the short narrow slot portions 98 of the slot 95. When the narrow shank portion 106 is positioned in any of the short narrow slot portions 98, as is shown in FIG. 8, relative rotation between the adjusting member 84 and the leg 16 is precluded, whereas when the narrow shank portion 106 is positioned in any one of the circular slot portions 97 (not shown) relative rotation between the adjusting member 84 and the leg 16 can be effected. A conventional washer 110 and a nut 111 threaded upon threads or a threaded portion 112 of the bolt 100 retains the elements just described in the assembled relationship best shown in FIGS. 7 and 8 of the drawings.

Figure 2:
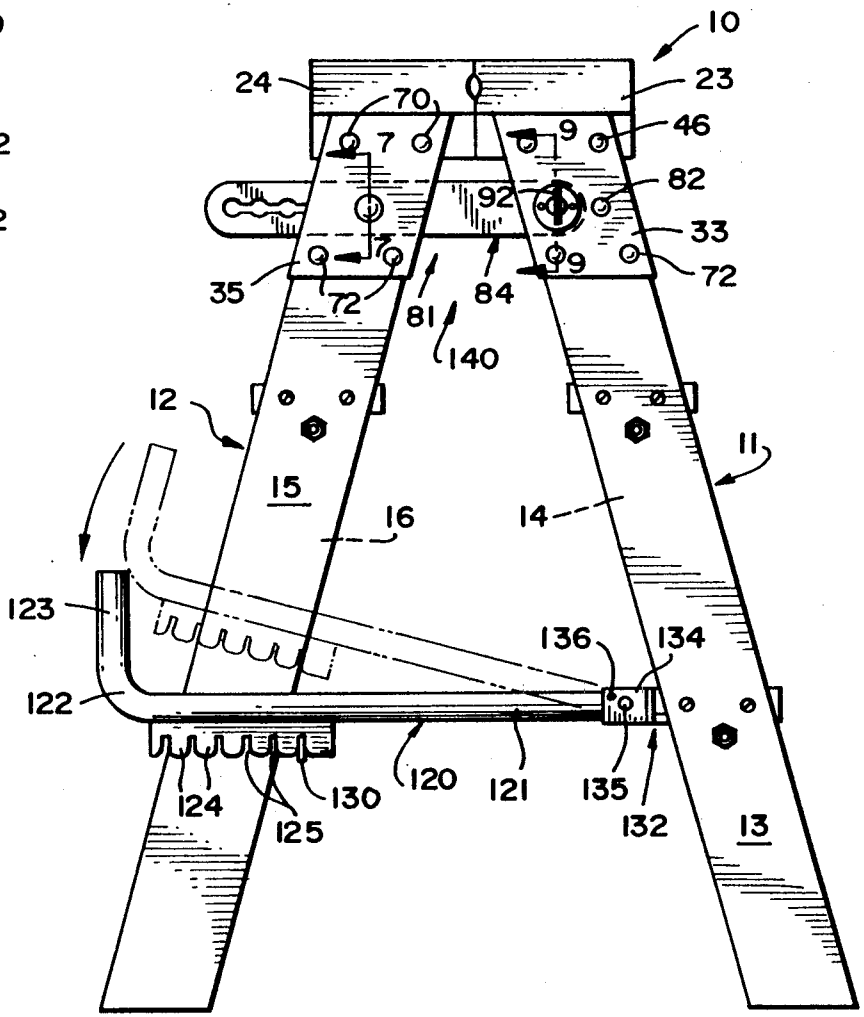
FIG. 2 is an enlarged side elevational view of the ladder-clamp mechanism of FIG. 1, and illustrates means at upper ends of the sides for selectively adjustably connecting the upper portions to each other to vary the spatial relationship between the clamping members carried thereby.

Reference is made to FIGS. 2 and 3 of the drawings which illustrate means in the form of a retaining bar or member 120 for holding the legs 13, 14 in a selected position relative to the legs 15, 16. The means or retaining bar or member 120 is generally L-shaped in configuration and includes a main leg 121 joined by a bend or radius 122 to an upperwardly directed arm or handle 123. A plate 124 includes a plurality of downwardly opening relatively spaced slots 125. The plate 124 is welded to the underside of the leg 121 and the slots 125 cooperatively engage an upwardly directed finger 130 of a bracket 131 which is fastened to the rail 15 and the rung 26 by bolts or screws (not shown) in a conventional fashion. A U-shaped bracket 132 is conventionally fixed to the rail 13 and includes a pair of spaced resilient arms 133, 134 bridged by a pivot pin 135 which passes through an opening (not shown) of the leg 121 which allows the retaining bar or member 120 to be pivoted between the solid outline locked position and the phantom outline unlocked position shown in FIG. 2. The legs 133, 134 each (or either) includes an inwardly directed dimple or projection 136 which will hold the retaining member 120 in an uppermost position after the maximum diameter of the leg 121 is passed above the dimple (or dimples) 136. However, since the legs 133, 134 are resilient, the handle 123 can be pushed downwardly from the phantom outline position to override the retaining force of the dimple or projection(s) 136 and the legs 133, 134 to effectively permit movement to the solid line locked position of FIG. 2.

The description of the convertible ladder-clamp combination will now be described, and it is first assumed that the convertible ladder-clamp combination 10 is to be used strictly as a ladder. In this case rigidity is of paramount importance, and therefore with respect to each of the selective adjustable connecting means 80, 81, the thumbscrew 92 thereof is in the locked position shown in FIG. 10, the narrow shank portion 106 of the bolt 100 is in a long narrow terminal slot end portion 96, and the finger 130 is in the right-handmost slot 125 of the plate 124, as shown in FIG. 2. With the elements thus positioned, the rails or legs 13, 14 are locked with respect to the adjusting members 84 by the end 88 of each thumbscrew 92 being received in the opening 87 of the adjusting member 84. Similarly, the legs 15, 16 cannot move relative to the adjusting members 84 because of the narrow shank portions 106 of the bolts 100 located in the long narrow terminal slot end portions 96. In this position the legs 13, 14 and 15, 16 are in their maximum spread or downwardly divergent relationship, and in this position the L-shaped brackets 40, 50 are in abutment, as shown in FIG. 4. In this position the ladder 10 is totally rigidified and immobilized and it would not even be necessary to lock the retaining bar or member 120, but for added safety, the same need be but moved from the phantom to the solid outline position to bring the illustrated slot 125 in locking engagement with the finger 130. A user can then freely walk up and down the rungs 21–26.

When the user wishes to clamp a workpiece W between the clamping members 23, 24, the retaining member 120 is moved to the phantom outline position shown in FIG. 2. Once the retaining bar 120 has been moved to the phantom outline position and the thumbscrews 92 have been retracted (FIG. 10), the sides 11, 12 can be bodily shifted toward or away from each other by, for example, simply pulling the side 12 to the left, as is indicated by the double headed arrow in FIG. 2. The narrow shank portions 106 of the bolts 100 move freely out of the long narrow terminal slot end portions 96 (FIG. 4), pass any of the circular slot portions and then can be positioned in any one of the narrow slot portions 98 at which relative rotation is precluded in the manner heretofore described. This movement spaces the clamping members 23, 24 away from each other to accommodate a particular workpiece between the clamping surfaces 123, 124 (FIG. 4). With the workpiece thus positioned the retaining member 120 is moved from the phantom to the solid outline position to bring another one of the slots 125 into engagement with the finger 130. However, before the latter is done, the thumbscrews 92 must be retracted to the position shown in FIG. 10 to allow relative pivoting movement between the side 11 and the adjusting members 80, 81 about the bolts 82. Referring again to FIG. 2 and assuming that the retaining member 120 is in the phantom outline position and that the side 12 has been adjusted to a spaced position, the bottom of the side 11 is pushed to the right, as indicated by the unnumbered headed arrow associated therewith which results in counterclockwise pivoting of the side 11 relative to the bolt 82 which brings the clamping member 23 toward the clamping member 24 with the result that any workpiece therebetween will be clamped proportionate to the force generated by the pivoting just described. If the preselected distance or space between the members 23, 24 prior to clamping is smaller than the size of the workpiece to be clamped therebetween, the aforementioned pivoting not only pivots the clamping member 23 toward the clamping member 24 and against the workpiece therebetween, but also moves the clamping member to the left, as viewed in FIG. 2, against the biasing force of the springs 68. The latter is particularly advantageous if the workpiece or object being clamped between the clamping members 23, 24 is made of relatively frangible or brittle material, such as plastic pipe, copper tubing, etc. Once the ladder-clamping action has been achieved, the retaining member or bar 120 is simply moved from the phantom to the solid outline position to maintain the clamping action freeing the hands of the user to operate upon the workpiece W clamped between the clamping members 23, 24.

Figure 13:
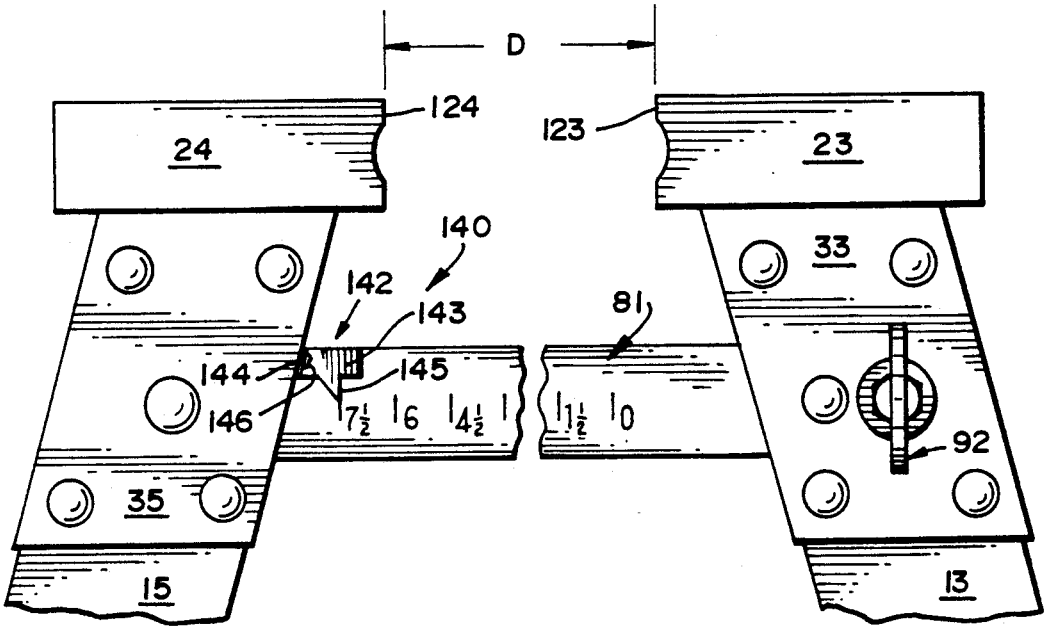
FIG. 13 is an enlarged fragmentary side elevational view of the upper portion of the convertible ladder-clamp mechanism illustrated in FIG. 2, and shows the clamping members spaced a relatively great distance from each other and size indications in inches on the adjusting member.

During the operation just described, it is apparent that the user of the ladder-clamp combination 10 is required through experience, measurement or guesswork to adjust the distance between the clamping members 23, 24 before clamping the workpiece W therebetween. To avoid guess work and at times measurement, means 140 (FIGS. 2 and 13) are provided for establishing a predetermined distance D between the clamping surfaces 123, 124 of the respective clamping members 23, 24. For purposes of clarity, the slot means 95 of the adjusting member 84 of the adjusting means 81 have not been illustrated but would be utilized in the manner heretofore described with markings or indicia 141 marked in inches, for example, 1½", 3", 4½", 6", etc. A metallic indicator mechanism 142 is a generally L-shaped metallic bracket having an arm 143 and another arm 144 normal to the arm 143. Screws 146 secure the arm 144 to the leg 15 through an opening (not shown) in the sleeve 35. The arm 143 includes a pointer 145. The pointer is illustrated in FIG. 3 aligned with the indicia "7½"". At this setting a workpiece W of a nominal size of 7½" will be firmly clamped between the surfaces 123, 124 when the sides 11, 12 are pivoted relative to each other and locked by the retaining bar 120 in the manner earlier described relative to FIG. 2. If adjusted to bring the pointer 145 to the indicia 1½", the distance D would then accommodate a workpiece having a nominal size of 1½". In this manner standard materials such as 2×4 studs could be clamped without measurement since the nominal size is known and thus the distance D could be readily set utilizing the pointer 145 and the indicia 141.

Figure 15:
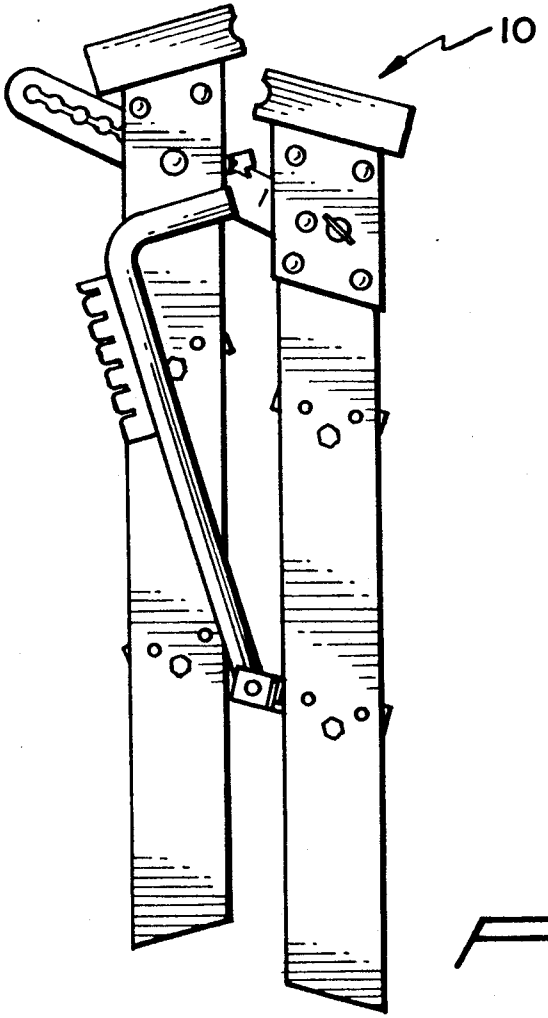
FIG. 15 is a schematic side elevational view of the convertible ladder-clamp mechanism of FIG. 1, and illustrates the same in a second adjusted collapsed storage position thereof.
Figure 14:
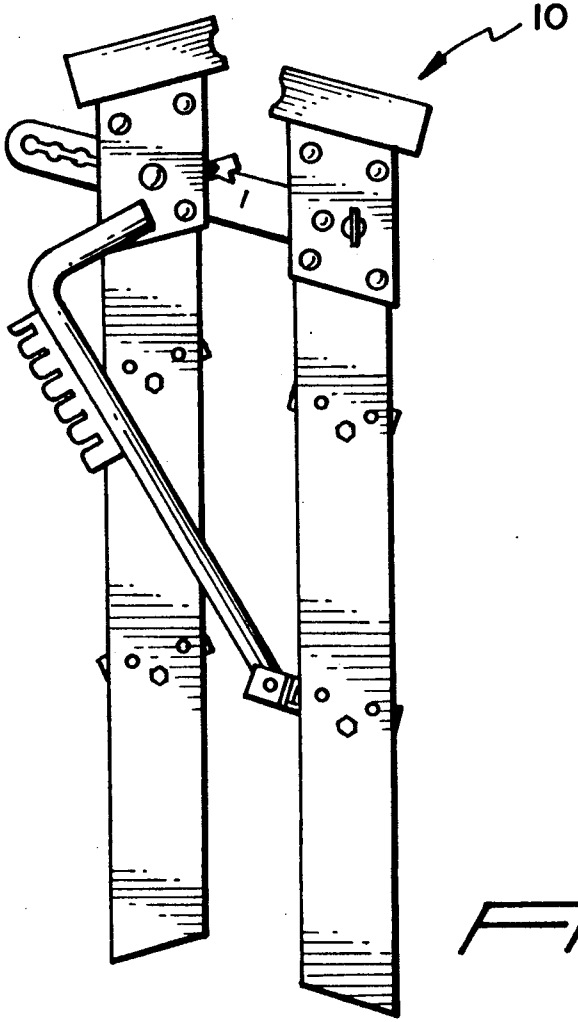
FIG. 14 is a schematic side elevational view of the convertible ladder-clamp mechanism of FIG. 1, and illustrates the same in a first adjusted collapsed position.

Reference is made to FIG. 14 which illustrates the convertible ladder-clamp combination 10 in one of two nonuse positions in which the bolt 100, and specifically the narrow shank portion 106 thereof, is at the end of the long narrow terminal slot end portion 96 (FIG. 4) of each of the adjusting members 84 and the ends 88 of the thumbscrews 92 are in the openings 87 of the adjusting members 84. In this position the sides 12 are disposed relatively close to each other. However, to achieve maximum collapse position when storage space might be a problem, the user need but move each of the narrow shank portions 106 of the bolts 100 to the circular slot portion 97, most adjacent the long narrow terminal slot end portion 96 of each adjusting member 84 and retract each thumbscrew 92 to the position shown in FIG. 10. This frees side members 11, 12 to pivot about the bolts 82 and 100 resulting in the intimate adjacent relationship of the side members 11, 12 shown in FIG. 15.

Figure 11:
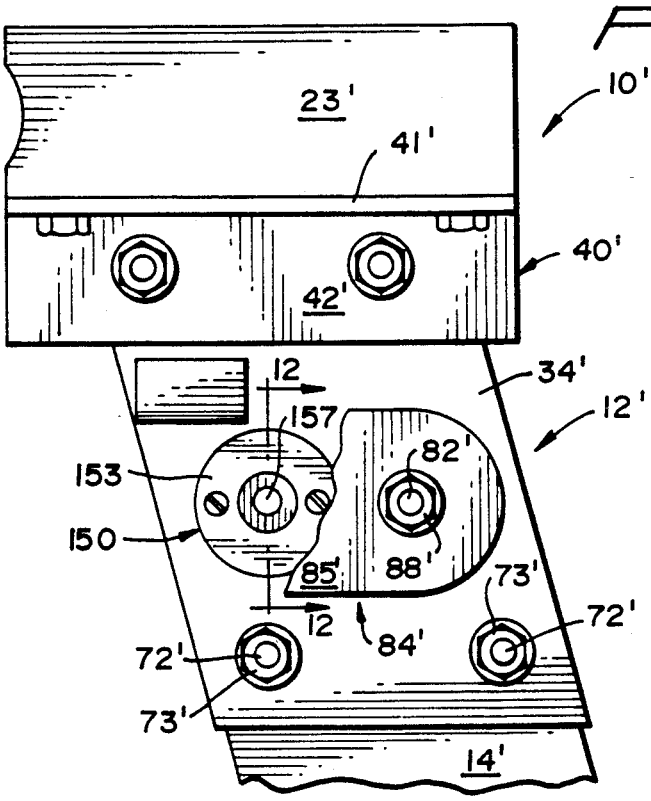
FIG. 11 is a fragmentary side elevational view of an upper portion of a side of another convertible ladder-clamp combination or mechanism, and illustrates a biased ball plunger associated with an associated adjusting member or bar.
Figure 12:
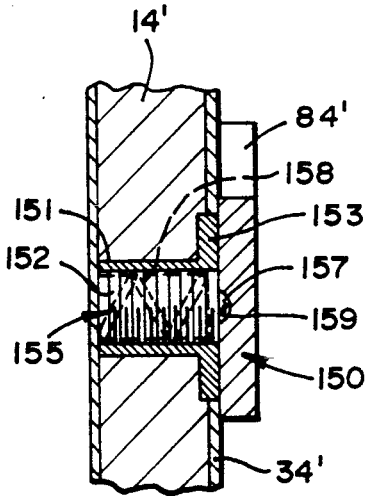
FIG. 12 is a fragmentary cross sectional view taken generally along line 12—12 of FIG. 11, and illustrates the manner in which the plunger ball holds the adjusting member or bar in a generally horizontal position when the ladder-clamp mechanism is in its operative position.

Reference is now made to FIGS. 11 and 12 which partially illustrates another convertible ladder-clamp combination which is essentially identical to the convertible ladder-clamp combination 10 earlier described and thus has identical though primed reference numerals applied to identical structure. However, in lieu of the thumbscrew 92 and sleeve 94 of FIGS. 9 and 10, means 150 are provided for selectively permitting and preventing relative pivoting movement between an adjusting member 84' and a rail or leg 14'. The means 150 is fully illustrated in FIG. 12 and includes a sleeve 151 having internal threads 152 and a flange 153. A ball plunger capsule 155 has external threads 156 which are threaded into the threads 152 of the sleeve 151. The ball plunger capsule 155 is of a conventional construction and includes a ball 157 which is biased to the right, as viewed in FIG. 12, by an internal spring 158. The spring 158 thereby normally biases the ball 157 into a hemispherical recess 159 in the adjusting member 84'. When the ball 157 is biased by the spring 156 into the recess 159, the adjusting member 84' is biasingly locked to prevent relative pivoting movement of the adjusting member 84' relative to the leg 14' about the pivot 82'. However, the spring biasing force of the spring 156 can be overcome by appropriately applying manual force which causes the ball 157 to retract into the ball plunger capsule 155 as it leaves the hemispherical recess 159 which in turn allows relative pivoting of the adjusting member 84' relative to the leg 14' about the pivot 82'.

Though FIGS. 11 and 12 have been described relative to the leg 14' of the side 12', it is to be understood that identical means 150 and the associated hemispherical recess 159 would be similarly associated with the opposite unillustrated leg (corresponding to the leg 13 of the combination 10) and its associated adjusting member (corresponding to the adjusting member 84 associated with the leg 13).

Figure 16:
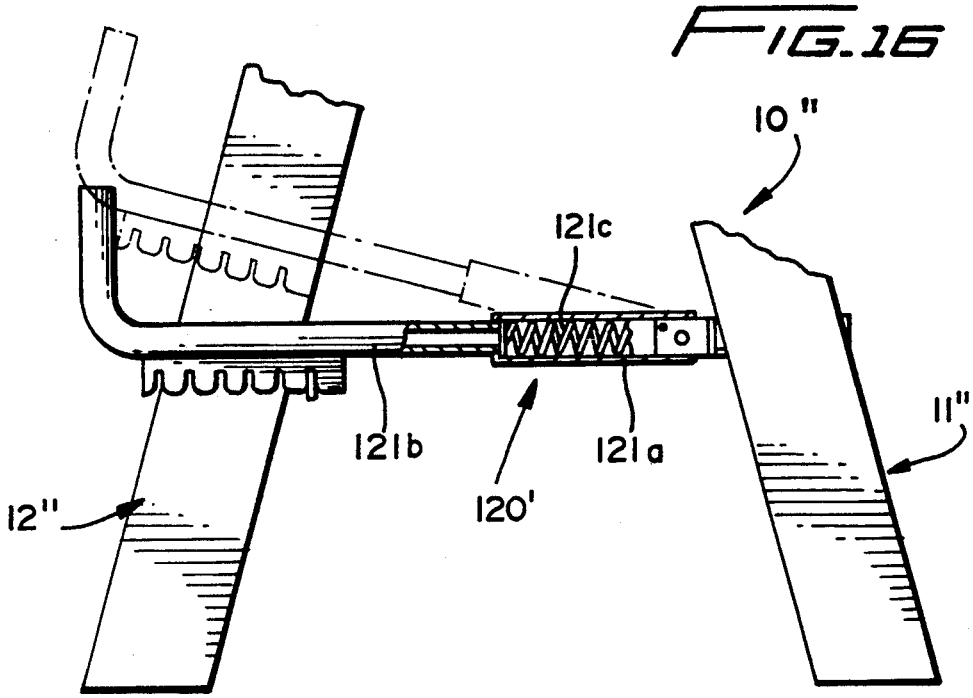
FIG. 16 is a fragmentary schematic view of a lower portion of another convertible ladder-clamp mechanism, and illustrates a spring-biased retaining member for biasing sides in downward diverging relationship.

Another means for holding the sides in generally upwardly converging relationship and substantially any relative spatial relationship of the clamping members 23, 24 is illustrated in FIG. 16 and is generally designated by the reference numeral 120'. As compared to the means 120 of FIG. 2, means 120' includes a tube **121*a* into which is telescopically slidably received a tube 12*b* having a closed end (unnumbered) against which bears a compression spring 121, 121*c* housed in the tube 121*a*. The spring 121*c* normally biases the leg 121*b* to the left, as viewed in FIG. 16. This arrangement allows the sides 11", 12"** to be retained under a biasing force constantly urging the bottom ends thereof away from each other thereby likewise urging the clamping members (not shown) toward each other.

Figure 17:
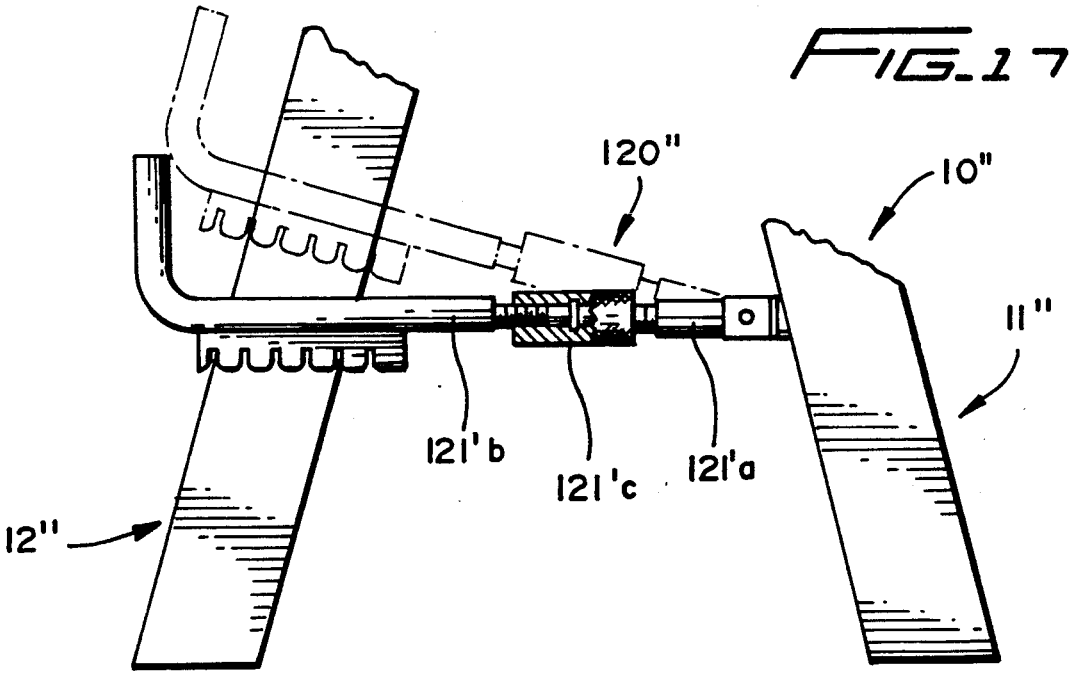
FIG. 17 is a schematic fragmentary side elevational view of another convertible ladder-clamp mechanism, and illustrates a turnbuckle operated retaining member or bar for urging and maintaining sides in downwardly diverging relationship.

FIG. 17 illustrates a side 11''' of another convertible ladder-clamp combination 10''' in which in lieu of the two tubes **121*a*, 121*b* and the spring 120*c* of FIG. 16, means 120" includes a conventional internally threaded turnbuckle into which threaded end portions (unnumbered) of legs 121'a and 121'b are threaded. Manual rotation of the turnbuckle 121'c in either of selected directions will increase or decrease the force tending to spread the sides 11''', 12'''** relative to each other.

Although a preferred embodiment of the invention has been specifically illustrated and described herein, it is to be understood that minor variations may be made in the apparatus without departing from the spirit and scope of the invention, as defined in the appended claims.

I claim:

1. A convertible ladder-clamp combination comprising first and second sides each having upper and lower end portions, each upper end portion having a clamping member, said first and second sides being positionable in upwardly generally converging relationship in a first position in which the combination is utilized as a ladder and in a second position in which the combination is utilized as a clamp for clamping an object between said clamping members, means for selectively adjustably connecting said upper portions to each other to vary the spatial relationship between said clamping members, and means for holding said sides in upwardly converging relationship in substantially any relative spatial relationship of said clamping members as established by said selectively adjustably connecting means whereby an object between said clamping members will be retained firmly clamped therebetween.

2. The convertible ladder-clamp combination as defined in claim 1 including means for urging at least one of said clamping members in a direction toward another of said clamping members.

3. The convertible ladder-clamp combination as defined in claim 1 including means for spring biasing at least one of said clamping members in a direction toward another of said clamping members.

4. The convertible ladder-clamp combination as defined in claim 1 including means for screw urging at least one of said clamping members in a direction toward another of said clamping members.

5. The convertible ladder-clamp combination as defined in claim 1 including means for slidably mounting at least one of said clamping members for movement in a direction toward another of said clamping members.

6. The convertible ladder-clamp combination as defined in claim 1 including means for slidably mounting one of said clamping members relative to another of said first and second sides and to another of said clamping members.

7. The convertible ladder-clamp combination as defined in claim 1 including means for slidably mounting one of said clamping members relative to another of said first and second sides and to another of said clamping members, and means for biasing said one clamping member in a direction toward said other clamping member.

8. The convertible ladder-clamp combination as defined in claim 1 wherein said holding means includes a holding member in spanning relationship to said first and second side lower end portions in the first position of said first and second sides.

9. The convertible ladder-clamp combination as defined in claim 1 wherein said selectively adjustable connecting means includes an adjusting member having opposite end portions, means for pivotally connecting a first of said adjusting member end portions to said first side upper portion, and said selectively adjustable connecting means including a stepwise adjustable connection means between said adjusting member and said second side upper portion for effecting a stepwise adjustable connection between said first and second side upper portions.

10. The convertible ladder-clamp combination as defined in claim 1 wherein said selectively adjustable connecting means includes an adjusting member having opposite end portions, means for pivotally connecting a first of said adjusting member end portions to said first side upper portion, said selectively adjustable connecting means including a stepwise adjustable connection means between said adjusting member and said second side upper portion for effecting a stepwise adjustable connection between said first and second side upper portions, said stepwise adjustable connection means includes a slot having spaced enlarged slot portions formed in said adjusting member and an adjusting pin carried by said second side upper portion received in said slot.

11. The convertible ladder-clamp combination as defined in claim 2 wherein said holding means includes a holding member in spanning relationship to said first and second side lower end portions in the first position of said first and second sides.

12. The convertible ladder-clamp combination as defined in claim 2 wherein said selectively adjustable connecting means includes an adjusting member having opposite end portions, means for pivotally connecting a first of said adjusting member end portions to said first side upper portion, and said selectively adjustable connecting means including a stepwise adjustable connection means between said adjusting member and said second side upper portion for effecting a stepwise adjustable connection between said first and second side upper portions.

13. The convertible ladder-clamp combination as defined in claim 2 wherein said selectively adjustable connecting means includes an adjusting member having opposite end portions, means for pivotally connecting a first of said adjusting member end portions to said first side upper portion, said selectively adjustable connecting means including a stepwise adjustable connection means between said adjusting member and said second side upper portion for effecting a stepwise adjustable connection between said first and second side upper portions, said stepwise adjustable connection means includes a slot having spaced enlarged slot portions formed in said adjusting member and an adjusting pin carried by said second side upper portion received in said slot.

14. The convertible ladder-clamp combination as defined in claim 3 wherein said holding means includes a holding member in spanning relationship to said first and second side lower end portions in the first position of said first and second sides.

15. The convertible ladder-clamp combination as defined in claim 3 wherein said selectively adjustable connecting means includes an adjusting member having opposite end portions, means for pivotally connecting a first of said adjusting member end portions to said first side upper portion, and said selectively adjustable connecting means including a stepwise adjustable connection means between said adjusting member and said second side upper portion for effecting a stepwise adjustable connection between said first and second side upper portions.

16. The convertible ladder-clamp combination as defined in claim 3 wherein said selectively adjustable connecting means includes an adjusting member having opposite end portions, means for pivotally connecting a first of said adjusting member end portions to said first side upper portion, said selectively adjustable connecting means including a stepwise adjustable connection means between said adjusting member and said second side upper portion for effecting a stepwise adjustable connection between said first and second side upper portions, said stepwise adjustable connection means includes a slot having spaced enlarged slot portions formed in said adjusting member and an adjusting pin carried by said second side upper portion received in said slot.

17. The convertible ladder-clamp combination as defined in claim 6 wherein said holding means includes a holding member in spanning relationship to said first and second side lower end portions in the first position of said first and second sides.

18. The convertible ladder-clamp combination as defined in claim 6 wherein said selectively adjustable connecting means includes an adjusting member having opposite end portions, means for pivotally connecting a first of said adjusting member end portions to said first side upper portion, and said selectively adjustable connecting means including a stepwise adjustable connection means between said adjusting member and said second side upper portion for effecting a stepwise adjustable connection between said first and second side upper portions.

19. The convertible ladder-clamp combination as defined in claim 6 wherein said selectively adjustable connecting means includes an adjusting member having opposite end portions, means for pivotally connecting a first of said adjusting member end portions to said first side upper portion, said selectively adjustable connecting means including a stepwise adjustable connection means between said adjusting member and said second side upper portion for effecting a stepwise adjustable connection between said first and second side upper portions, said stepwise adjustable connection means includes a slot having spaced enlarged slot portions formed in said adjusting member and an adjusting pin carried by said second side upper portion received in said slot.

20. The convertible ladder-clamp combination as defined in claim 7 wherein said selectively adjustable connecting means includes an adjusting member having opposite end portions, means for pivotally connecting a first of said adjusting member end portions to said first side upper portion, and said selectively adjustable connecting means including a stepwise adjustable connection means between said adjusting member and said second side upper portion for effecting a stepwise adjustable connection between said first and second side upper portions.

21. The convertible ladder-clamp combination as defined in claim 7 wherein said selectively adjustable connecting means includes an adjusting member having opposite end portions, means for pivotally connecting a first of said adjusting member end portions to said first side upper portion, said selectively adjustable connecting means including a stepwise adjustable connection means between said adjusting member and said second side upper portion for effecting a stepwise adjustable connection between said first and second side upper portions, said stepwise adjustable connection means includes a slot having spaced enlarged slot portions formed in said adjusting member and an adjusting pin carried by said second side upper portion received in said slot.

22. The convertible ladder-clamp combination as defined in claim 8 wherein said selectively adjustable connecting means includes an adjusting member having opposite end portions, means for pivotally connecting a first of said adjusting member end portions to said first side upper portion, and said selectively adjustable connecting means including a stepwise adjustable connection means between said adjusting member and said second side upper portion for effecting a stepwise adjustable connection between said first and second side upper portions.

23. The convertible ladder-clamp combination as defined in claim 7 wherein said selectively adjustable connecting means includes an adjusting member having opposite end portions, means for pivotally connecting a first of said adjusting member end portions to said first side upper portion, said selectively adjustable connecting means including a stepwise adjustable connection means between said adjusting member and said second side upper portion for effecting a stepwise adjustable connection between said first and second side upper portions, said stepwise adjustable connection means includes a slot having spaced enlarged slot portions formed in said adjusting member and an adjusting pin carried by said second side upper portion received in said slot.

* * * * *